US008485954B2

(12) United States Patent
Liao

(10) Patent No.: US 8,485,954 B2
(45) Date of Patent: Jul. 16, 2013

(54) BOX FOLDING APPARATUS

(75) Inventor: Shu-Ming Liao, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 374 days.

(21) Appl. No.: 12/856,774

(22) Filed: Aug. 16, 2010

(65) Prior Publication Data

US 2011/0136642 A1 Jun. 9, 2011

(51) Int. Cl.
*B31B 1/60* (2006.01)

(52) U.S. Cl.
USPC ..... 493/117; 493/147; 493/183; 493/382; 53/136.4; 53/372.2; 53/378.3

(58) Field of Classification Search
USPC ..... 493/117, 147, 183, 382; 53/136.4, 53/136.6, 136.1, 372.2, 378.3, 491, 415, 53/282
See application file for complete search history.

(56) References Cited

U.S. PATENT DOCUMENTS

| | | | | | |
|---|---|---|---|---|---|
| 3,775,937 | A | * | 12/1973 | Devan et al. | 53/75 |
| 4,218,862 | A | * | 8/1980 | Marchetti | 53/377.2 |
| 4,262,468 | A | * | 4/1981 | Marchetti | 53/67 |
| 4,293,086 | A | * | 10/1981 | Fincher et al. | 225/1 |
| 4,422,282 | A | * | 12/1983 | Marchetti | 52/374 |
| 5,323,586 | A | * | 6/1994 | Lissoni et al. | 53/136.4 |
| 5,454,776 | A | * | 10/1995 | Ulrich et al. | 493/117 |
| 5,480,371 | A | * | 1/1996 | Morita et al. | 493/117 |
| 5,511,362 | A | * | 4/1996 | Morita et al. | 53/491 |
| 5,685,814 | A | * | 11/1997 | Le | 493/117 |
| 5,839,254 | A | * | 11/1998 | Chen | 53/377.2 |
| 5,916,106 | A | * | 6/1999 | Chen | 53/136.4 |
| 6,067,773 | A | * | 5/2000 | Le | 53/387.2 |
| 7,278,248 | B2 | * | 10/2007 | Vinh Le | 53/136.4 |
| 2002/0005258 | A1 | * | 1/2002 | Tsuken et al. | 156/510 |

FOREIGN PATENT DOCUMENTS

| | | | |
|---|---|---|---|
| CN | 2801641 | Y | 8/2006 |
| CN | 201211932 | Y | 3/2009 |

* cited by examiner

*Primary Examiner* — Thanh Truong
(74) *Attorney, Agent, or Firm* — Altis Law Group, Inc.

(57) ABSTRACT

A box folding apparatus operable to close the top of a box having four flaps is provided. The boxing folding apparatus includes a worktable, a feeding assembly for transporting the box from an upstream position of the worktable to a downstream position of the worktable. A first folding assembly includes a rotatable folding arm, a second folding assembly includes a stationary resisting bar inclined toward the feeding assembly in the direction in which the box is transported, and a third folding assembly includes a first inclined surface and a second inclined surface intersecting with the first inclined surface. The first and second inclined surfaces extend toward and gradually close to the feeding assembly in the direction in which the box is transported.

18 Claims, 7 Drawing Sheets

BOX FOLDING APPARATUS

BACKGROUND

1. Technical Field

The present disclosure generally relates to a box folding apparatus.

2. Description of Related Art

The packaging industry relies upon efficient packing, folding and sealing of corrugated boxes, commonly referred to as cartons or cases. During the process of packaging a product, the product is first placed in a box, and then the flaps of the box are folded and sealed to cover the opening thereof. Generally, the flaps are folded and sealed manually, thereby more manpower is required and the packaging efficiency is relatively low.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
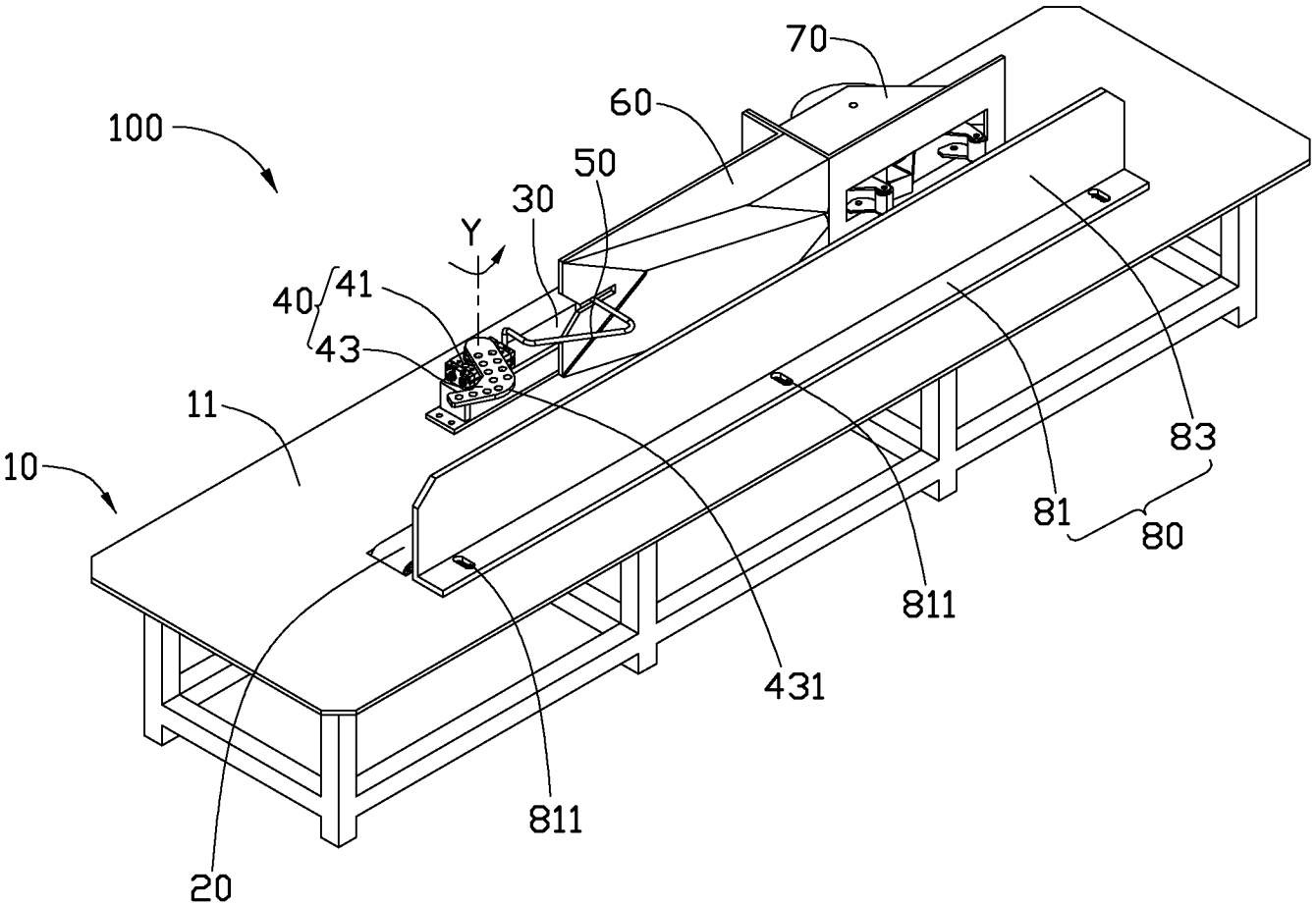
FIG. 1 is an isometric view of a first embodiment of a box folding apparatus.
Figure 6:
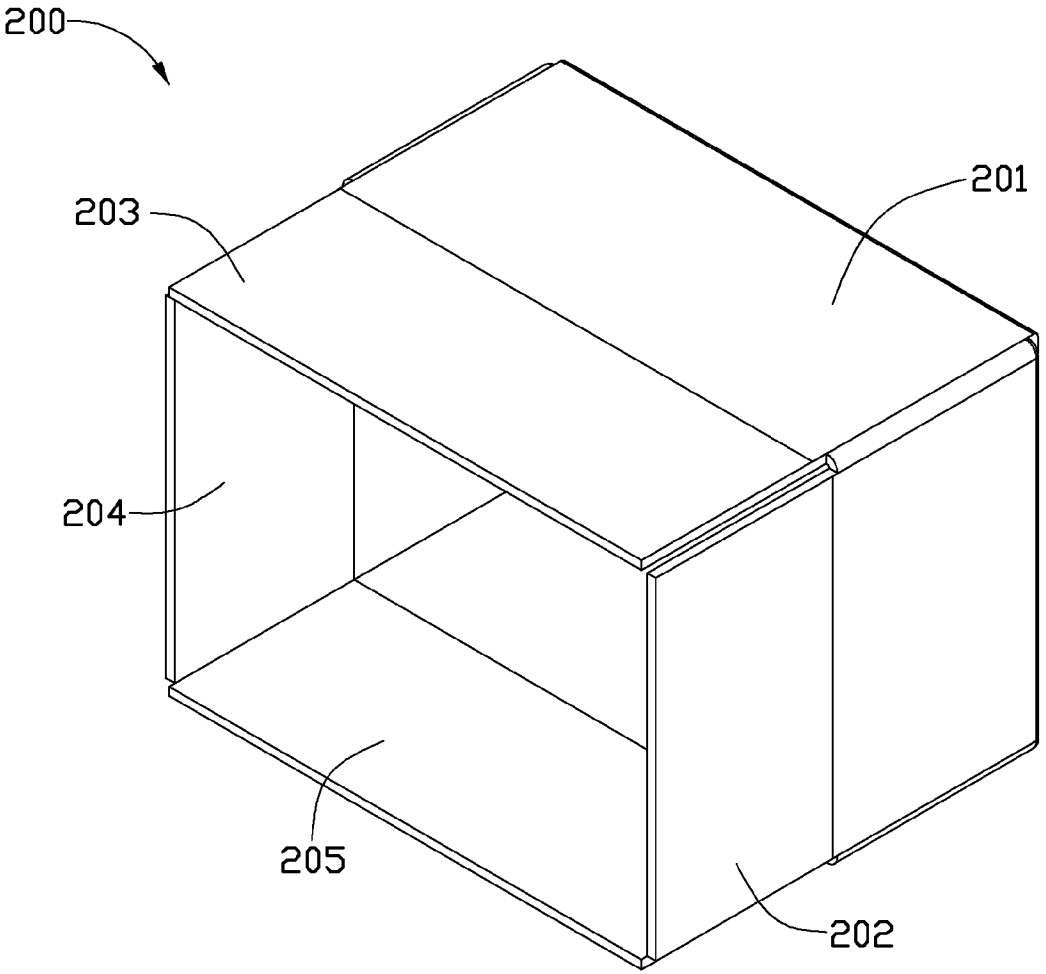
FIG. 6 is an isometric view of a box to be folded by the box folding apparatus of FIG. 1.

Referring to FIG. 1, a first embodiment of a box folding apparatus 100 configured to close and seal the top of a box to be folded, such as the box shown in FIG. 6, is shown. The box folding apparatus 100 includes a worktable 10 having a support surface 11, a feeding assembly 20, a fixing bracket 30, a first folding assembly 40, a second folding assembly 50, a third folding assembly 60, a sealing assembly 70, and a guiding member 80. The feeding assembly 20 is adapted to transport a plurality of boxes or cases to be folded from an upstream position of the worktable 10 to a downstream position of the worktable 10. In one embodiment, the feeding assembly 20 employs a belt transport mechanism to convey the boxes. The first, second, and third folding assemblies 40, 50, and 60 are arranged on the support surface 11 in an order at a predetermined interval. The sealing assembly 70 is mounted on the downstream position of the worktable 10 for sealing the folded boxes.

Figure 2:
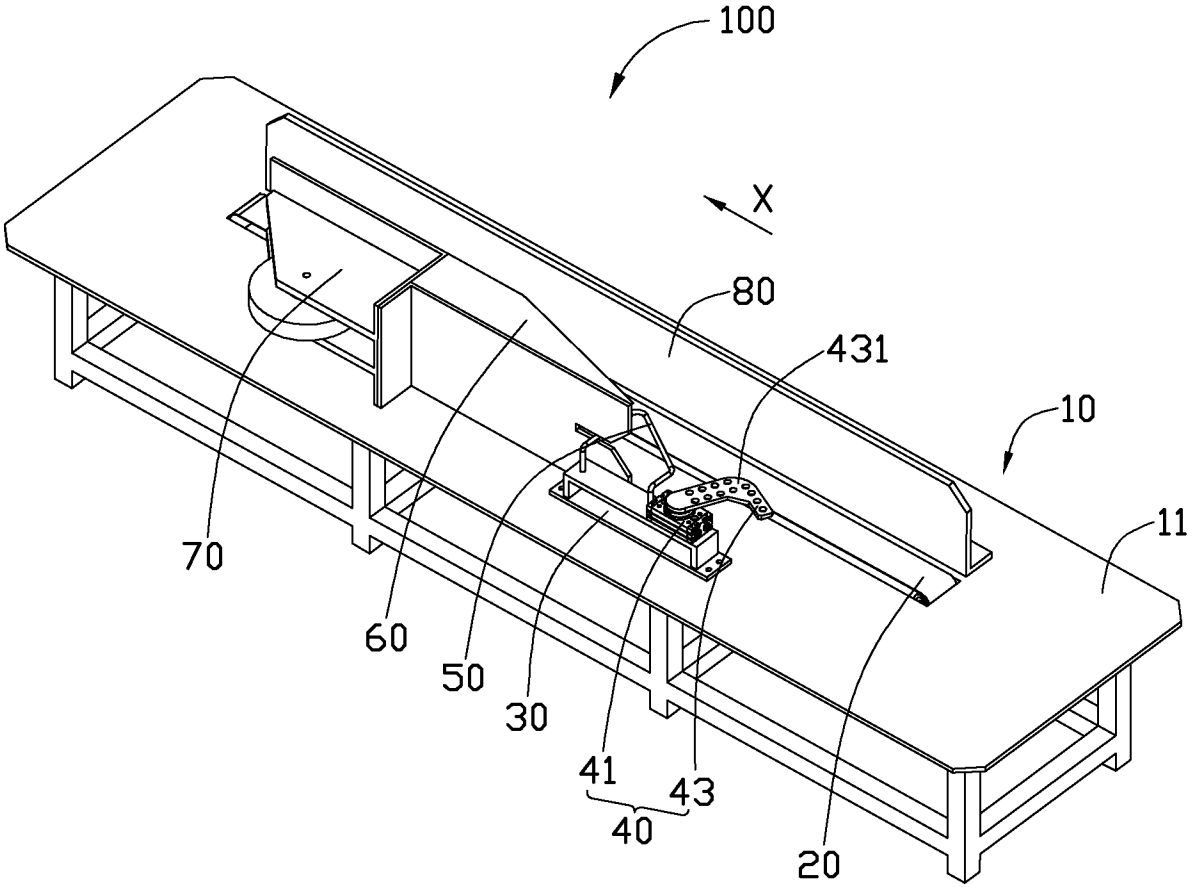
FIG. 2 is similar to FIG. 1, but viewed from another aspect.
Figure 3:
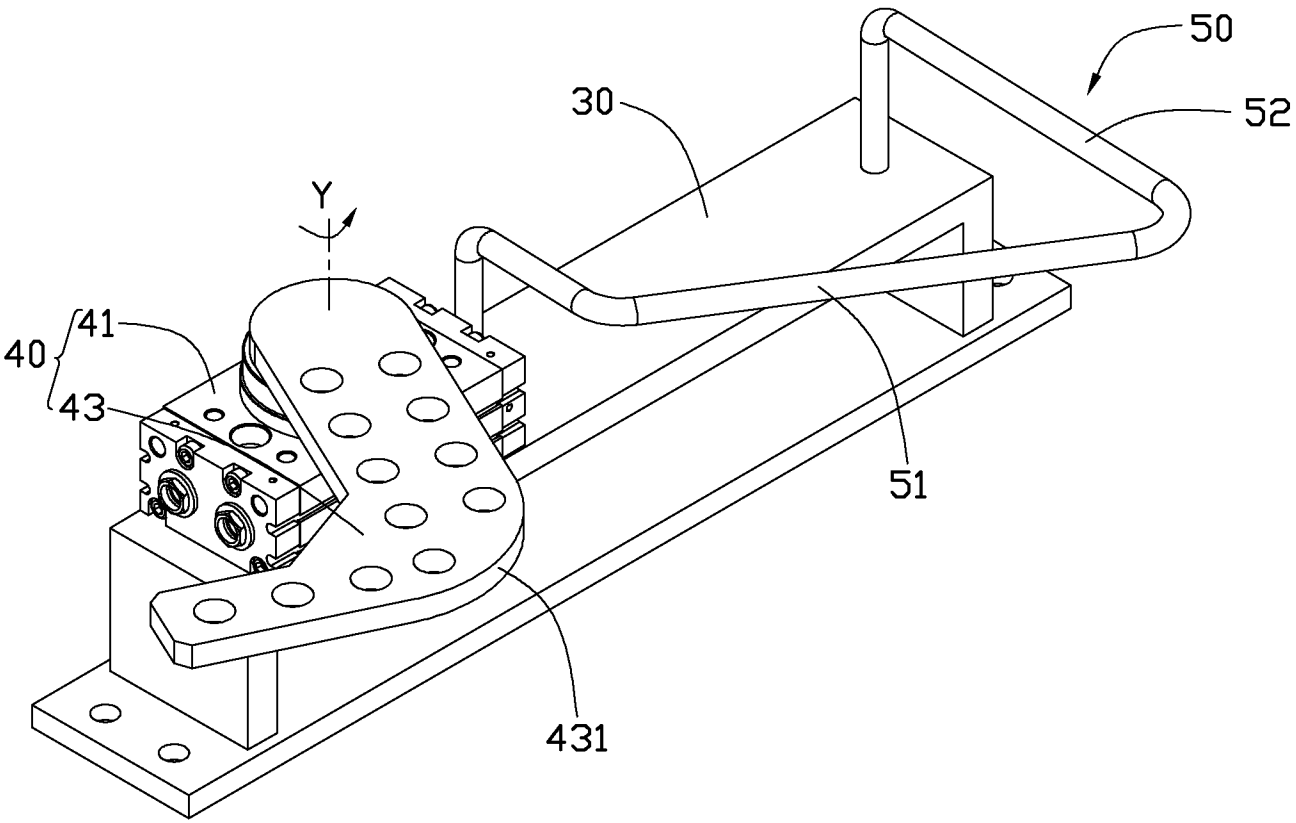
FIG. 3 is an isometric view of a fixing bracket, a first folding assembly, and a second assembly of the box folding apparatus of FIG. 1.

Referring to FIGS. 2 and 3, the fixing bracket 30 is fixed on the worktable 10 to support the first and second folding assemblies 40 and 50.

The first folding assembly 40 includes an actuator 41 and a rotatable folding arm 43. The folding arm 43 is capable of rotating about an axis Y, as indicated in FIGS. 1 and 3, and is driven by the actuator 41. The folding arm 43 includes a resisting portion 431, which is adapted to fold a flap of a box 200. The actuator 41 can be a motor or a rotation cylinder. In one embodiment, the folding arm 43 is substantially "L"-shaped, and the resisting portion 431 is substantially arcuate, and is located on the turning point of the folding arm 43, thus preventing the box 200 from being damaged as the box 200 is folded by the resisting portion 431.

The second folding assembly 50 includes a stationary resisting bar 51 and a connecting bar 52 connecting the resisting bar 51 and the fixing bracket 30. The resisting bar 51 is inclined toward the feeding assembly 20 in the direction indicated as direction X in FIGS. 2 and 5, in which the boxes 200 are transported. In an alternative embodiment, the stationary resisting bar 51 of the second folding assembly 50 can be a wedge-shaped block having an inclined resisting surface to fold the box 200.

Figure 4:
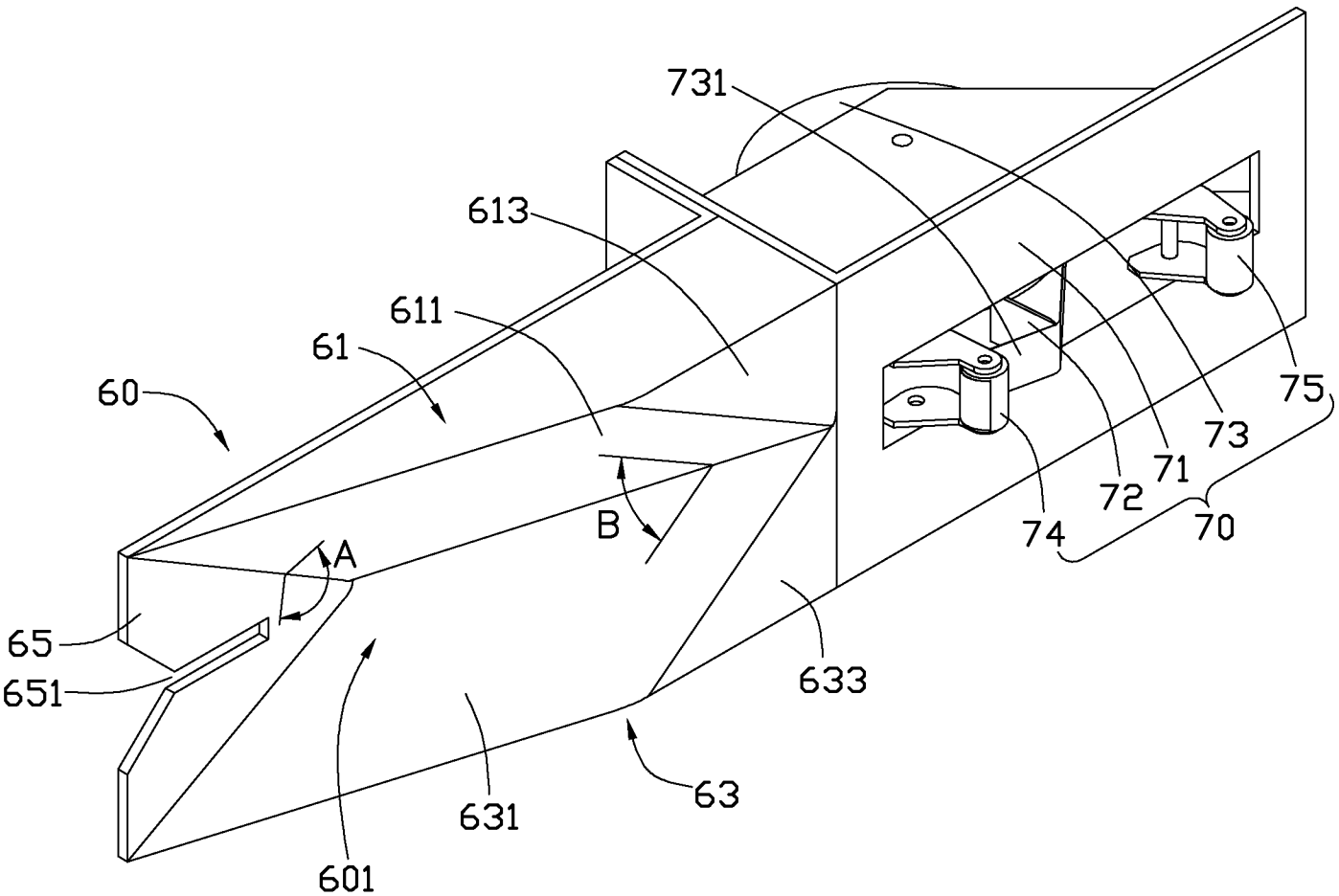
FIG. 4 is an isometric view of a third assembly and a sealing assembly of the box folding apparatus of FIG. 1.

Referring to FIGS. 2 and 4, the third folding assembly 60 includes a first wedge-shaped block 61, a second wedge-shaped block 63, and a connection member 65. The connection portion 65 is a plate extending in the direction X and substantially perpendicular to the support surface 11 of the worktable 10. The first and second wedge-shaped blocks 61 and 63 are fixed on the connection member 65.

The first wedge-shaped block 61 includes a first inclined surface 611 toward the feeding assembly 20 in the direction X, and a first datum plane 613 extending in the direction X and connected to the first inclined surface 611. The second wedge-shaped block 63 includes a second inclined surface 631 toward the feeding assembly 20 in the direction X, and a second datum plane 633 extending in the direction X and connected to the second inclined surface 631. The first and second inclined surfaces 611 and 631 are gradually inclined toward the feeding assembly 20 in the direction X, and are intersected and cooperatively define a groove 601 having an opening toward the feeding assembly 20. The first and second datum surfaces 613 and 631 are coplanar.

The connection member 65 defines a cutout 651 extending in the direction X to receive a part of the second folding assembly 50, thus shortening the overall length of the second and third folding assemblies 50 and 60, thereby the box folding apparatus 100 can achieve a more compact size.

As indicated in FIG. 4, the inclined angles of the first and second inclined surfaces 611 and 631 with respect to the connection member 65 are supplementary angles of an angle A. The inclined angle between the first and second inclined surfaces 611 and 631 is indicated as an angle B.

The angle A is in a range from about 110° to about 130°. In other words, the inclined angles of the first and second inclined surfaces 611 and 631 with respect to the connection member 65 are in a range from about 50° to about 70°. The angle B is in a range from about 40° to about 80°. In one embodiment, the angle A is about 120°, and the angle B is about 60°.

Figure 5:
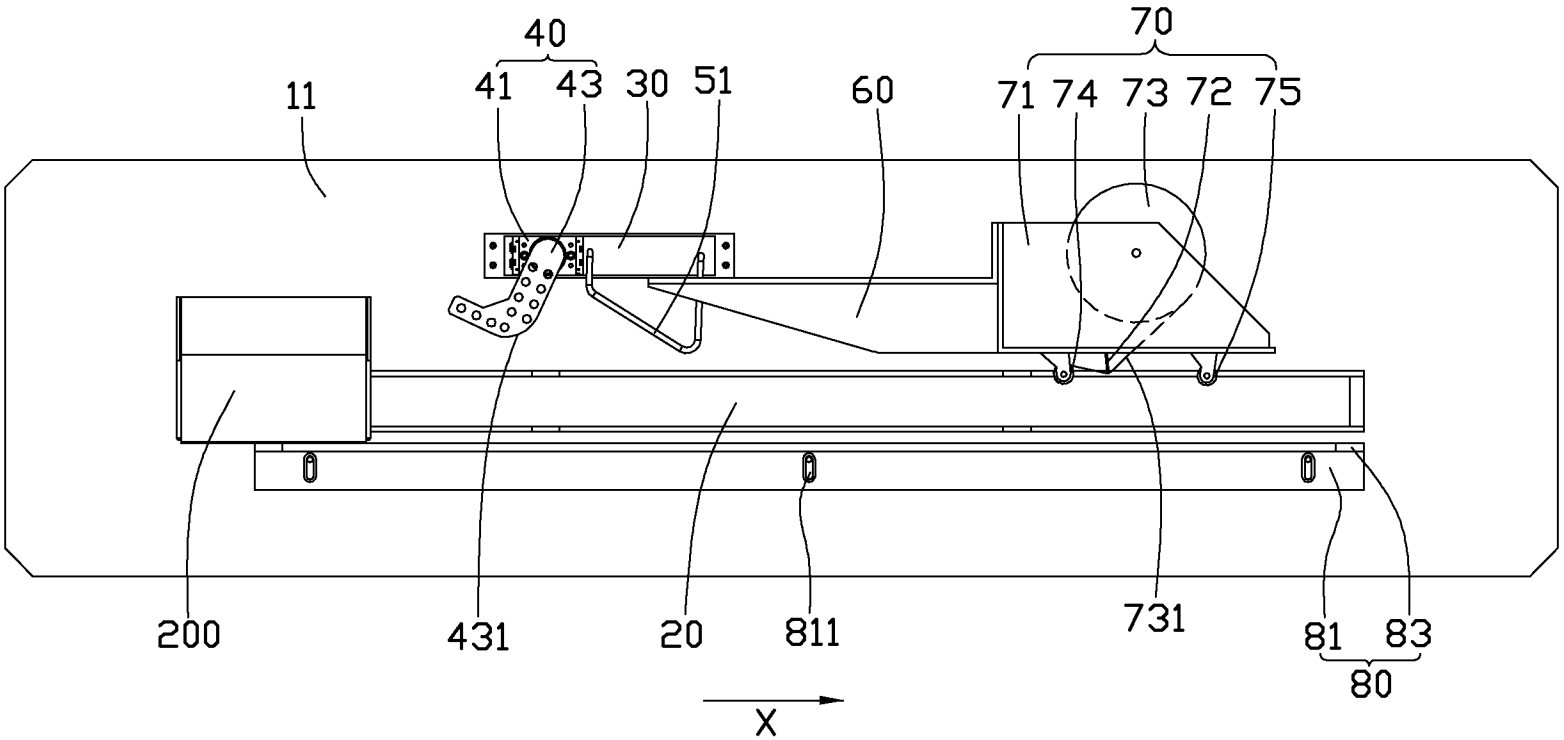
FIG. 5 is a top view of the box folding apparatus of FIG. 1.

Referring to FIGS. 4 and 5, the sealing assembly 70 includes a support member 71, a cutter 72 mounted on the support member 71, an adhesive roll 73 rotatable relative to the support member 71, a first roller 74, a second roller 75, and an adhesive tape 731 applied around the adhesive roll 73. The free end of the adhesive tape 731 is connected to the first roller 74; thus, the first roller 74 can draw the adhesive tape 731 when it rotates. The cutter 72 makes contact to the adhesive tape 731 for cutting the adhesive tape 731.

Referring to FIG. 1 again, the guiding member 80 is a substantially "L" shaped elongated plate and extends along the direction X. The guiding member 80 includes a connecting plate 81 and a guiding plate 83. The connecting plate 81 defines a plurality of kidney holes 811, and the connecting plate 81 is fixed to the worktable 10 with a plurality of screws (not labeled) received in the kidney holes 811, respectively.

The position of the guiding member 80 can be horizontally adjusted to accommodate the dimensions of each box by adjusting the position of the screw received in the kidney hole 811. In one embodiment, the guiding plate 83 is substantially perpendicular to the support surface 11.

In order to facilitate an understanding of the principles associated with the foregoing apparatus, its operation will be briefly described. Boxes of various heights and widths, such as the box 200 shown in FIG. 6, are placed in a row on top of the feeding assembly 20. The box 200 includes a main body 201 which defines an opening, and includes a first flap 202, a second flap 203 adjacent to the first flap 202, a third flap 204 opposite to the first flap 202, and a fourth flap 205 opposite to the second flap 203 extending from the four edges of the opening, respectively.

Referring to FIGS. 1, 2 and 6, the feeding assembly 20 moves the box 200 downstream. Before the box 200 passes the first folding assembly 40, the actuator 41 rotates the folding arm 43 to a first predetermined position away from the feeding assembly 20, thus allowing the third flap 204 to pass without contacting the folding arm 43. As the box 200 is further moved downstream, the third flap 204 contacts the resisting bar 51, and is folded inwardly by the resisting bar 51 of the second folding assembly 50. After the box 200 passes the first folding assembly 40, the actuator 41 rotates the folding arm 43 toward the feeding assembly 20 to a second predetermined position. As the folding arm 43 rotates to the second predetermined position, the resisting portion 431 contacts and inwardly folds the first flap 202.

Referring to FIG. 4, as the box 200 is moved further downstream, the second flap 203 and the fourth flap 205 are gradually moved into the groove 601 of the second folding assembly 60, and contact the first and inclined surfaces 611 and 631, respectively. The second and fourth flaps 203 and 205 are gradually folded inward. When the second and fourth flaps 203 and 205 are moved to a position which contacts the first and second datum planes 613 and 633, the box 200 is folded.

The feeding assembly 20 then moves the folded box 200 further downstream to the sealing assembly 70 where the box 200 is sealed. The adhesive tape 731 wound around the first roller 74 is adhered to an end of the second and fourth flaps 203 and 205. When the first flap 202 passes the cutter 72, the cutter 72 cuts the adhesive tape 731. When the box 200 contacts the second roller 75, the second roller 75 rolls on the adhesive tape 731, so that the adhesive tape 731 is steadily adhered to the box 200.

From the foregoing, it can be realized that the box folding apparatus 100 can properly fold the first, second, third, and fourth flaps 202, 203, 204, and 205 using the first, second, and third folding assemblies 40, 50, and 60. Then the folded box 200 is further sealed using the sealing assembly 70, thus improving the packaging efficiency of the box 200. In addition, the folding process of the box 200 only requires manpower to place the boxes 200 on the feeding assembly 20, thus less manpower is required.

Figure 7:
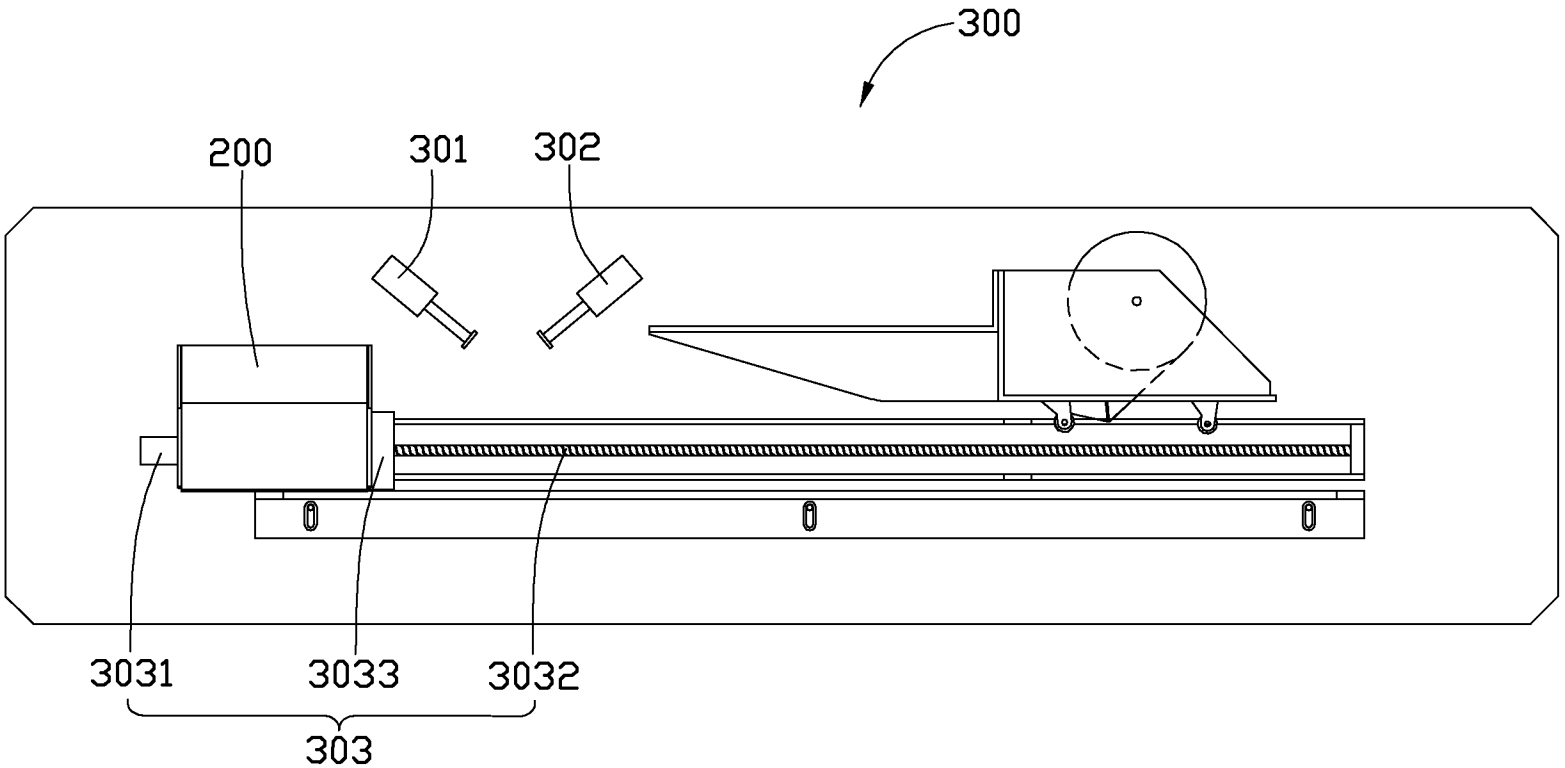
FIG. 7 is a plane view of a second embodiment of a box folding apparatus.

Referring to FIG. 7, a second embodiment of the box folding apparatus 300 is shown. The box folding apparatus 300 differs from the box folding apparatus 100 only in that the first folding assembly 301 and the second folding assembly 302 utilize a plurality of propellers driven by a plurality of cylinders to fold the flaps of the box 200. The feeding assembly 303 includes a motor 3031, a screw bar 3032 driven by the motor 3031, and a support member 3033 screwed onto the screw bar 3032. The box 200 to be folded can be placed on the support member 3033 and moved downstream as the motor 3031 rotates the screw bar 3032.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A box folding apparatus configured to close the top of a box having a plurality of flaps to be folded, the boxing folding apparatus comprising:

a worktable;

a feeding assembly for transporting the box from an upstream position of the worktable to a downstream position of the worktable;

a first folding assembly comprising a rotatable folding arm;

a second folding assembly comprising a stationary resisting bar inclined toward the feeding assembly in the direction in which the box is transported; and a third folding assembly comprising a first wedge-shaped block positioned on the worktable and a second wedge-shaped block positioned on the first wedge-shaped block away from the worktable, wherein the first wedge-shaped block comprises a first inclined surface, the second wedge-shaped block comprises a second inclined surface intersecting with the first inclined surface, the first and second inclined surfaces extend toward and gradually close to the feeding assembly in the direction in which the box is transported.

2. The box folding apparatus of claim 1, wherein the first folding assembly further comprises an actuator to rotate the rotatable folding arm from a first predetermined position to a second predetermined position.

3. The box folding apparatus of claim 2, wherein the actuator is a motor or a rotation cylinder.

4. The box folding apparatus of claim 1, wherein the folding arm is substantially "L" shaped and comprises a resisting portion which is substantially arcuate, and is located on a turning point of the folding arm.

5. The box folding apparatus of claim 1, further comprising a sealing assembly mounted on a downstream position of the worktable for sealing the folded box.

6. The box folding apparatus of claim 5, wherein the sealing assembly comprises a support member mounted on the worktable, an adhesive tape, an adhesive roll rotatable relative to the support member for carrying the adhesive tape, a first roller for connecting an end of the adhesive tape, and a cutter mounted on the support member for cutting off the adhesive tape.

7. The box folding apparatus of claim 6, the sealing assembly further comprises a second roller mounted on the support member for contacting the adhesive tape.

8. The box folding apparatus of claim 1, further comprising a guiding member for guiding the transport of the box.

9. The box folding apparatus of claim 8, wherein the guiding member comprises a connecting plate defining a plurality of kidney holes, a guiding plate contacting the box, and a plurality of screws received in the kidney holes respectively to connect the guiding member to the worktable, wherein the position of the guiding member is capable of being adjusted by adjusting the position of the screws received in the kidney holes.

10. The box folding apparatus of claim 1, wherein the stationary resisting bar is a wedge-shaped block having an inclined resisting surface for folding the box.

11. The box folding apparatus of claim 1, wherein the third folding assembly further comprises a connection member on which the first and second wedge-shaped blocks are fixed, the connection member extending in the direction in which the box is transported.

12. The box folding apparatus of claim 11, wherein the connection member defines a cutout extending in the direction in which the box is transported to receive a part of the second folding assembly.

13. The box folding apparatus of claim 11, wherein the third folding assembly comprises a first datum plane extending in the direction in which the box is transported and a second datum plane extending in the direction in which the box is transported, the first and second datum planes are coplanar and are connected to the first and second inclined surfaces, respectively.

14. The box folding apparatus of claim 11, wherein the inclined angles of the first and second inclined surfaces with respect to the connection member are both in a range from 50 degrees to 70 degrees, and the inclined angle between the first and second inclined surfaces is in a range from 40 degrees to 80 degrees.

15. The box folding apparatus of claim 14, wherein the inclined angles of the first and second inclined surfaces with respect to the connection member are both about 60 degrees, and the inclined angle between the first and second inclined surfaces is about 60 degrees.

16. A box folding apparatus operable to close the top of a box, the box comprising a first flap, a second flap adjacent to the first flap, a third flap opposite to the first flap, and a fourth flap opposite to the second flap, the boxing folding apparatus comprising:

a worktable;

a feeding assembly for transporting the box from an upstream position of the worktable to a downstream position of the worktable;

a first folding assembly comprising a rotatable folding arm, the rotatable folding arm being capable of rotating from a first predetermined position without contacting the box to a second predetermined position to fold the first flap;

a second folding assembly comprising a stationary resisting bar inclined toward the feeding assembly in the direction in which the box is transported to fold the third flap;

a third folding assembly comprising a first wedge-shaped block positioned on the worktable and a second wedge-shaped block positioned on the first wedge-shaped block away from the worktable, wherein the first wedge-shaped block comprises a first inclined surface and the second wedge-shaped block comprises a second inclined surface intersecting with the first inclined surface, the first and second inclined surfaces extending toward and gradually closing to the feeding assembly in the direction in which the box is transported to fold the second and fourth flaps, respectively; and a sealing assembly to seal the box.

17. The box folding apparatus of claim 16, wherein the sealing assembly comprises a support member mounted on the worktable, an adhesive tape, an adhesive roll rotatable relative to the support member for carrying the adhesive tape, a first roller for connecting an end of the adhesive tape, a cutter mounted on the support member for cutting off the adhesive tape, and a second roller mounted on the support member for contacting the adhesive tape.

18. The box folding apparatus of claim 16, wherein the third folding assembly further comprises a connection member on which the first and second wedge-shaped blocks are fixed, the connection member extending in the direction in which the box is transported, a first datum plane extending in the direction in which the box is transported, and a second datum plane extending in the direction in which the box is transported, the first and second datum planes are coplanar and are connected to the first and second inclined surfaces, respectively.

* * * * *